US006398545B1

(12) United States Patent
Kleeman et al.

(10) Patent No.: US 6,398,545 B1
(45) Date of Patent: Jun. 4, 2002

(54) SELF EXTINGUISH TORCH

(75) Inventors: Jeffrey Adam Kleeman, Le Bec; Joseph N. Tawil, Pacific Palisades, both of CA (US)

(73) Assignee: GamProducts, Inc., Hollywood, CA (US)

( * ) Notice: Subject to any disclaimer, the term of this patent is extended or adjusted under 35 U.S.C. 154(b) by 0 days.

(21) Appl. No.: 09/672,557

(22) Filed: Sep. 28, 2000

Related U.S. Application Data

(60) Provisional application No. 60/157,509, filed on Oct. 4, 1999.

(51) Int. Cl.[7] ..... F23Q 13/00; F23Q 21/00

(52) U.S. Cl. ..... 431/327; 431/152; 431/146; 431/345

(58) Field of Search ..... 431/252, 125, 431/127, 128, 345, 344, 129, 298, 144, 146, 148, 150, 153, 327, 277, 249, 310, 311, 312, 313, 152; 362/159, 162, 171, 178, 415, 266

(56) References Cited

U.S. PATENT DOCUMENTS

| | | | | | |
|---|---|---|---|---|---|
| 813,331 | A | * | 2/1906 | Tarling | 431/34 |
| 921,633 | A | * | 5/1909 | Stokes et al. | 431/34 |
| 974,727 | A | * | 11/1910 | Victor | 431/34 |
| 1,115,214 | A | * | 10/1914 | Krich | 431/34 |
| 1,377,875 | A | * | 5/1921 | Coen | 431/327 |
| 1,496,028 | A | * | 6/1924 | Scott | 431/327 |
| 1,755,746 | A | * | 4/1930 | Perrera | 431/277 |
| 2,393,508 | A | * | 1/1946 | Anderson | 431/327 |
| 2,429,829 | A | * | 10/1947 | Lersch | 431/327 |

FOREIGN PATENT DOCUMENTS

| | | | | |
|---|---|---|---|---|
| JP | 411159755 | * | 6/1999 | 431/345 |

OTHER PUBLICATIONS

Hand sketch of *Prior Art* referred to at p. 1, lines 22–25 of the Specification. (No Date).

* cited by examiner

*Primary Examiner*—Carl D. Price
(74) *Attorney, Agent, or Firm*—William Michael Hynes; Townsend and Townsend and Crew, LLP

(57) ABSTRACT

A self-extinguishing torch for use in theatrical environments includes a supporting basket having a support for torch fuel. The supporting basket includes a screen providing side ventilation for containing torch fuel on the support and admitting air through the side ventilation to burn torch fuel. The supporting basket has fuel, which provides torch lighting. A container having an opening for receiving, surrounding, and containing the supporting basket has a handhold remote from the container for permitting the container to be held by a hand. A normally closed top is provided for moving from an open position to a closed position over the container with the supporting basket therein. The normally closed top is biased to the open position when the supporting basket protrudes from the container at the normally closed top. A spring biases the supporting basket from a burning position exterior of the container to the opening of the container for receiving, surrounding and extinguishing the supporting basket interior of the container. A deadman on the container having an aperture engages a protuberance on the handhold. It maintains the supporting basket extended from the container with the normally closed top in the open position. When the deadman at the handhold is released, the deadman springs free of the protuberance. This biases the supporting basket into container occurs with closing of the normally closed top to extinguish the torch fuel in the supporting basket of the torch.

5 Claims, 3 Drawing Sheets

SELF EXTINGUISH TORCH

CROSS-REFERENCES TO RELATED APPLICATIONS

This application claims the benefit of U.S. Provisional Application No. 60/157,509, filed Oct. 4, 1999, the disclosure of which is incorporated by reference.

This invention relates the theatrical torches. More particularly, a theatrical torch is disclosed which requires firm grasp to remain lit; when grasp is relaxed, the torch is extinguished.

BACKGROUND OF THE INVENTION

Theatrical torches are well known for the dramatic effect provided. Simply stated, against the either a night scene or against appropriately dimly lit theatrical scenes and settings, the light and shadow effect of a moving hand held torch is dramatic.

Unfortunately, such torches are dangerous. There is an ever-present fire danger. In the modern theater environment, surroundings are typically highly flammable. Fire danger in a theater environment is notorious.

At the same time, the actor or thespian carrying such torches is the last person to be depended upon for fire safety. This actor or thespian is more concerned with the performance. And the scene with which he is concerned is either dimly lit or completely dark (except for the torch). Add this low light condition to either natural "stage fright" or the concern for professional acting projection and one has a dangerous situation.

It will be understood that a theatrical torch with a "deadman" has been used in the prior art. This device constituted a separate lever attached to the handhold of the torch. Unlike what is disclosed below, considerable continuous effort was required to maintain the torch in the burning disposition.

SUMMARY OF THE INVENTION

A self-extinguishing torch for use in theatrical environments is disclosed. The torch includes a supporting basket having a support for torch fuel. The supporting basket includes a screen providing side ventilation for containing torch fuel on the support and admitting air through the side ventilation to burn torch fuel. The supporting basket has an open top for permitting flame from the torch fuel to burn upward of the supporting basket to provide torch lighting. A container having an opening for receiving, surrounding, and containing the supporting basket has a handhold remote from the container for permitting the container to be held by a hand. A normally closed top is provided for moving from an open position to a closed position over the container with the supporting basket therein. This normally closed top is for extinguishing the torch fuel within the supporting basket. The normally closed top is biased to the open position when the supporting basket protrudes from the container at the normally closed top. A spring biases the supporting basket from a burning position exterior of the container to the opening of the container for receiving, surrounding and extinguishing the supporting basket interior of the container. A deadman having an aperture extends from the container down to and is biased inward by the hand of the holder to engage a protuberance on the handhold. This engagement maintains the supporting basket extended from the container with the normally closed top in the open position. When the deadman at the handhold is released, the aperture in the deadman springs free of the protuberance. Biasing of the supporting basket into container occurs with closing of the normally closed top to extinguish the torch fuel in the supporting basket of the torch.

Additionally, it is sometimes necessary to extinguish torches on que. Many scenes are at least impart degraded by the inability to physically and actually extinguish torches on que. The provided torch makes actor extinguishing on que a simple matter of releasing grip on the deadman; with immediate extinguishment of the torch occurring.

DESCRIPTION OF THE SPECIFIC EMBODIMENTS

Figure 1:
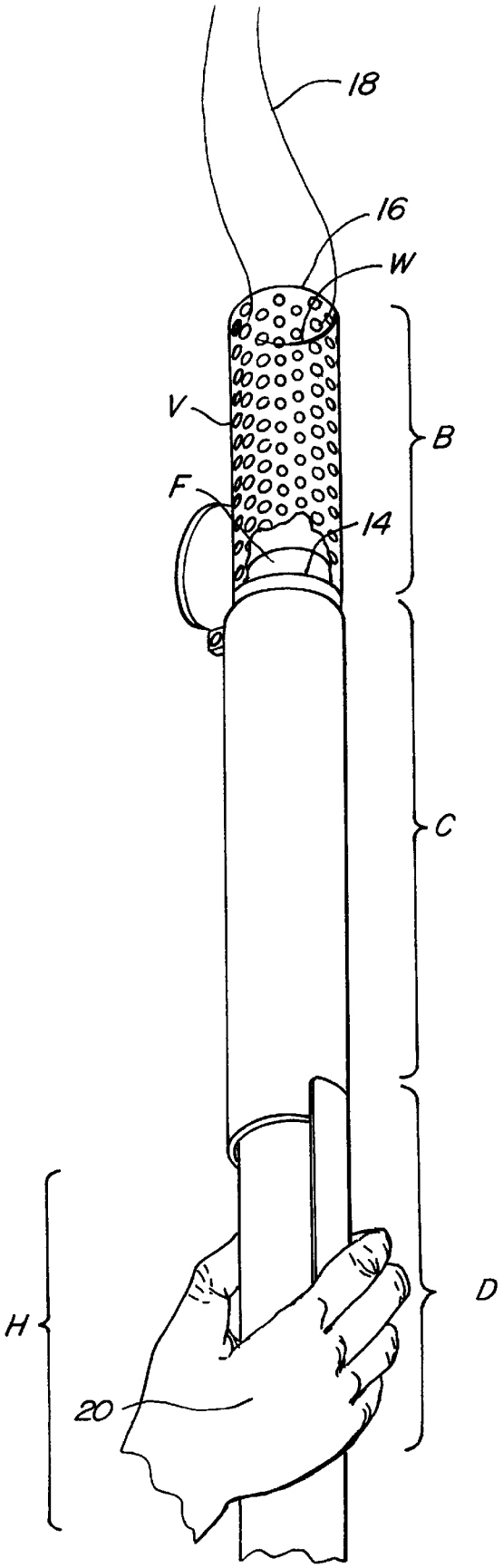
FIG. 1 is a perspective view of the torch of this invention in the open disposition with flame being schematically illustrated at the top of the torch.

Referring to FIG. 1, theatrical self-extinguishing torch T is shown in the lighted configuration. Simply stated, in the burning disposition, self-extinguishing torch T has supporting basket B protruding free and clear of a extinguishing container C. In such protrusion, supporting basket B biases normally closed spring biased cover O to the open disposition allowing lighted fuel pellet F to produce the torch illumination effect.

Supporting basket B includes fuel support 14 and surrounding ventilated screen V. As shown through the broken away portion of surrounding ventilated screen V, fuel pellet F has been ignited and has extending flame 18. Extending flame 18 can safely protrude as much as 16 inches from supporting basket B; the reader will understand that the full extent of the illumination provided is not fully illustrated. For safety, wire W passes through surrounding ventilated screen V and maintains fuel pellet F within supporting basket B.

Supporting basket B is attached at the bottom to handhold H. Handhold H attaches at its upper end to the bottom of supporting basket B and extends downward away from supporting basket B to the bottom of self-extinguishing torch T where it may be conveniently grasped. As will hereafter be made clear, when hard 20 grasps handhold H over deadman D, it maintains extinguishing container C away from supporting basket B enabling the torch to burn. When hand 20 is removed from deadman D, supporting basket B is enclosed interior of extinguishing container C and extinguished by normally closed spring biased cover O capping extinguishing container C and eliminating necessary oxygen to fuel pellet F in supporting basket B.

Extinguishing container C is provided for receiving, surrounding, and containing supporting basket B. Extinguishing container C has deadman D protruding downward along one side of handhold H. This deadman D comprises a simple band of metal which is fastened at the exterior of container C and is biased away from handhold H, a bias that is easily overcome by having hand 20 grasp both deadman D and handhold H. Deadman D is provided with aperture A which engages a protuberance P on handhold H.

Figure 2:
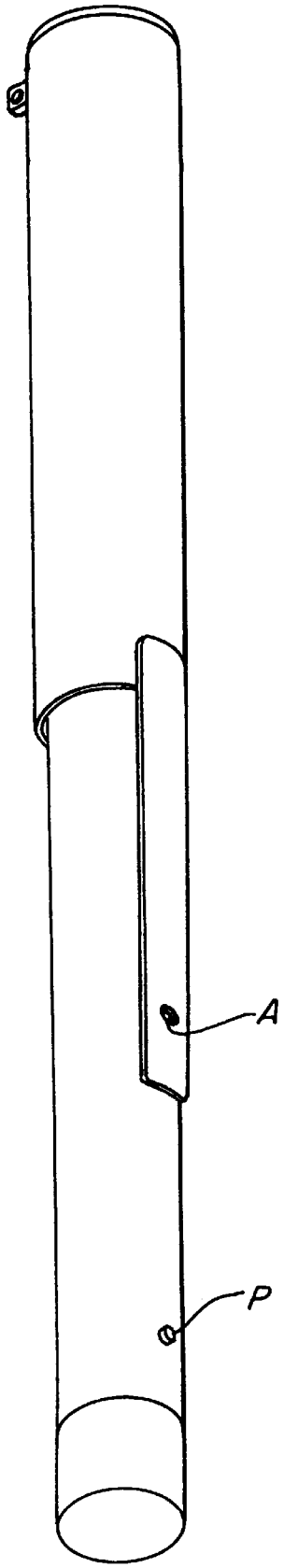
FIG. 2 is a perspective view similar to FIG. 1 illustrating the torch extinguished through release of the deadman at the handhold.

Referring briefly to FIG. 2, protuberance P on the exterior of handhold H is mated with aperture A on deadman D and held in registry by hand 20 when self-extinguishing torch T is burning. Once hand 20 releases deadman D, it spring biases away from protuberance P at aperture A. At this point, supporting basket B is biased interior of extinguishing container C and normally closed spring biased cover O snaps over and closes the top of extinguishing container C. Extinguishment of self-extinguishing torch T occurs.

Figure 3A:
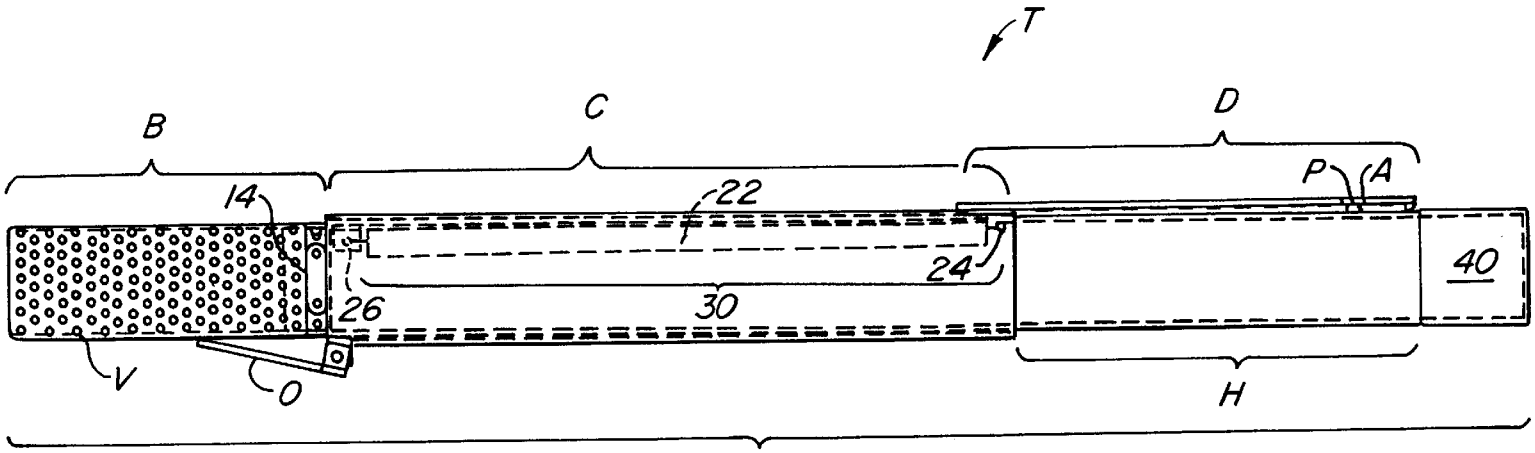
FIG. 3A is a side elevation illustrating the relative disposition of the discrete parts of the torch when the torch is disposed in the burning position of FIG. 1.
Figure 3B:
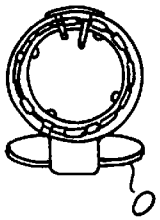
FIG. 3B is an elevation of the normally closed top biased to the open position by protrusion of the supporting basket.

Referring to FIGS. 3A and 3B, the detailed construction is set forth. Handhold H and deadman D maintain extinguishing container C away from supporting basket B. This occurs because hand 20 (not shown) biases deadman D at aperture A onto protuberance P from handhold H. Supporting basket B protrudes from the end of extinguishing container C and biases normally closed spring biased cover O to the open position.

Extinguishing container C is normally biased to cover and extinguish any flame in supporting basket B. Such bias occurs through tensioned coil spring 22 attached between hand hold spring tab 26 and extinguishing container spring tab 24. Stated in other terms, but for deadman D maintaining coil spring 22 in the tensioned position, supporting basket B would immediately be surrounded by extinguishing container C and normally closed spring biased cover O would cover and extinguish any extending flame 18 from self-extinguishing torch T.

It will be understood that in order for sliding movement to be accommodated, the handhold H must be provided with extinguishing container spring tab slot 30. For convenience of assembly, this extinguishing container spring tab slot 30 runs from the farther point of excursion of extinguishing container spring tab 24 to fuel support 14. The extinguishing container spring tab slot 30 is closed by fuel support 14 being fastened over the end of handhold H.

Figure 4A:
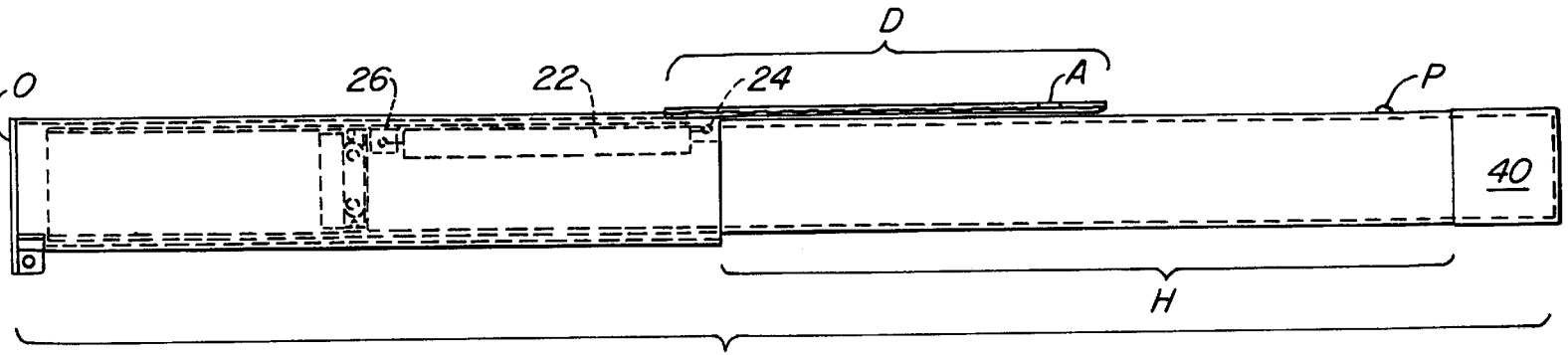
FIG. 4A is a side elevation illustrating the relative disposition of the discrete parts of the torch when the torch is disposed in the extinguished disposition illustrated in FIG. 2; and, FIG. 4B is an end elevation of the normally closed top.
Figure 4B:
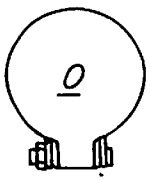

FIGS. 4A and 4B are believed to be largely self-explanatory. Upon release of deadman D, aperture. A springs free of protuberance P on handhold H, coil-spring 22 contracts biasing extinguishing container C about supporting basket B. When supporting basket B is completely enclosed interior of supporting basket B, normally closed spring biased cover O snaps closed over the end of extinguishing container C and immediate torch extinguishment occurs.

It will be noted that the bias of deadman D away from handhold H is assisted by the off center placement of hand hold spring tab 26 and extinguishing container spring tab 24 with coil spring 22 acting in tension between the tabs. When supporting basket B protrudes from the top of container C, a bias of deadman D at aperture A away from protuberance P is present. Specifically, this bias combined with the provided tension is greatest when the spring is extended and the torch is lit. The release of handhold H over deadman D enables aperture A to easily climb protuberance P to cause immediate release. Extinguishment rapidly follows.

For finishing, plastic cap 40 is placed over the end of handhold H.

The reader will understand that this invention will admit of variation. For example I disclose the use of supporting basket B and fuel pellets F as a preferred embodiment. Conventional torch wicks, burning banded material (such as bamboo), and all other conventional and non-conventional burning torch illumination can be used. Likewise, the bias of the torch to the extinguished position interior of the container can be altered. For example, air springs, elastic members, compressed members and the like could all be used.

While I illustrate what I believe to be the preferred embodiment, it will be understood that detail can be changed without departure from the spirit of this invention.

What is claimed is:

1. A self extinguishing torch comprising in combination:

a support for burning torch fuel to provide torch lighting;

a handhold attached to the support for burning torch fuel, the hand hold for permitting the support for burning torch fuel to be held from a hand holding the handhold;

a container having an opening for receiving, surrounding, and containing the support for burning torch fuel;

a normally closed top attached to an end of the container for moving from an open position to a closed position over the end of the container with the support for burning torch fuel therein for extinguishing burning torch fuel, the normally closed top is arranged to be biased to the open position when the support for burning torch fuel protrudes from the container at the end having the normally closed top;

a spring for biasing the container to surround the support for burning torch fuel; and, a deadman comprising a metal band on the container extending only partially over the handhold for maintaining the support for burning torch fuel extended from the container with the normally closed top in the open position during grasping by a hand of the deadman on the handhold of the torch whereby when the deadman at the handhold is released by a hand, biasing of the container around the support for torch fuel occurs with closing of the normally closed top to extinguish burning torch fuel on the support for torch fuel.

2. A self extinguishing torch according to claim 1 wherein the support for burning torch fuel comprises:

a supporting basket having side ventilation for containing torch fuel on the support for burning torch fuel and admitting air through the side ventilation to burn torch fuel, and an open top for permitting flame from burning torch fuel to burn upward of the supporting basket.

3. A self extinguishing torch according to claim 1 wherein the spring for biasing the container about support for burning torch fuel is a coil spring under tension between a tab on the container and a tab on the handhold.

4. A self extinguishing torch according to claim 3 wherein:

the coil spring is attached to a first tab on the handhold and a second tab on the container and the coil spring is attached on a side of the torch adjacent the deadman.

5. A self extinguishing torch according to claim 4 wherein:

the deadman is provided with an aperture and the handhold is provided with a protuberance; and, the aperture registers with the protuberance when the deadman is engaged and biases away from the protuberance when the deadman is released.

* * * * *